United States Patent [19]

Dardick

[11] Patent Number: 4,582,147

[45] Date of Patent: Apr. 15, 1986

[54] DIRECTIONAL DRILLING

[75] Inventor: David Dardick, New York, N.Y.

[73] Assignee: Tround International, Inc., New York, N.Y.

[21] Appl. No.: 399,098

[22] Filed: Jul. 16, 1982

[51] Int. Cl.[4] ..... E21B 47/12

[52] U.S. Cl. ..... 175/1; 175/4.5; 175/45; 175/61

[58] Field of Search ..... 175/4.5, 45, 4.51, 4.55, 175/48, 2, 4.57, 4.54, 61, 1; 73/151; 181/104

[56] References Cited

U.S. PATENT DOCUMENTS

| | | | |
|---|---|---|---|
| 1,811,648 | 6/1931 | Rosaire | 73/151 |
| 3,633,686 | 1/1972 | Bennet | 175/4.5 |
| 3,817,345 | 6/1983 | Bailey | 73/151 |
| 3,876,016 | 4/1975 | Stinson | 175/45 |
| 4,004,642 | 1/1977 | Dardick | 175/4.5 |
| 4,030,557 | 6/1977 | Alvis et al. | 175/4.5 |

*Primary Examiner*—Stephen J. Novosad
*Assistant Examiner*—Michael Goodwin
*Attorney, Agent, or Firm*—Alfred B. Levine

[57] ABSTRACT

A system for directional drilling of boreholes into the earth under control of the driller at the surface, employing a rotating earth drill including a projectile firing mechanism, that is timed to nonsymmetrically fire projectiles into the earth at controlled angular positions that are offset from the axis of the drill and drill string in the desired direction of drilling.

9 Claims, 6 Drawing Figures

DIRECTIONAL DRILLING

STATEMENT OF THE INVENTION

This invention generally relates to earth drilling, boring, and mining using successions of fired projectiles to fracture and crack rock; and more particularly to methods and apparatus for selectively controlling the direction of drilling, boring, or mining by selectively controlling the offset location of the fired projectiles.

BACKGROUND OF THE INVENTION

In oil well drilling, as well as in penetrations of the earth for other reasons, directional bores (other than straight) are often drilled to recover oil from inaccessible locations; to stop blowouts; to sidetrack wells; to by-pass broken drill pipe; and for various other reasons.

Conventional techniques for directional drilling in wells use a deflector in the borehole to push the bit sideways (e.g. "whipstocking"); or alternatively insert a bent joint in the drilling string (e.g. "bent subs"); or alternatively propell pressurized drill mud sideways through a nozzle in the drill to push the bit sideways (e.g. "side jetting").

The "whipstocking" process requires a series of separate operations including drilling of a pilot hole, reaming of the pilot hole to full gauge, and removal of the deflector, and is therefore a time consuming and costly process. The use of "bent subs" to produce lateral forces on the drill bit requires the use of expensive drill motors; and the "side jetting" process, using special drill bits to provide offset holes by the pressurized drill mud, does not function well in hard rock earth since the conventional mud pressures will not erode the hard rock materials.

SUMMARY OF THE PRESENT INVENTION

According to the present invention there is provided a method and apparatus for directional drilling that preferably employs a rotary terradynamic earth drill of the present inventor, (earlier U.S. Pat. No. 4,004,642), that drills, bores, or otherwise penetrates the earth, by also firing projectiles to fracture and break rock in combination with the rotary grinding and pulverizing of the rock by a rotary bit.

In this earlier patent, the drill fires salvos of projectiles in a symmetrical pattern with respect to the rotary drill axis and borehole; and the borehole is accordingly drilled in a rectilinear fashion as the drill proceeds into the earth.

According to the present invention, to drill or bore directional holes in a controlled nonrectilinear manner, the projectiles are repetitively fired in an unsymmetrical pattern, that is offset from the main axis of the drill, as the drill progresses into the earth, thereby to fracture and break the rock in a desired direction other than straight ahead. The advancement of the rotary drill into the bore therefore follows a controlled path in the direction desired.

In a preferred embodiment, the projectile firing mechanism is rotated with the drill bit and fires projectiles at positions offset from the central axis of the bit. To remotely control the drill to fire the projectiles at a desired offset position or location as the bit rotates, the angle of rotation of the drill string is monitored at the surface, and the firing of the projectiles is remotely controlled from the surface to be "timed" to occur when the firing mechanism is rotatively positioned at a desired angle.

Alternatively, the location and angular position of the drill and firing mechanism may be continuously monitored from the surface by triangulation from the acoustic waves, and the firing of the projectiles then remotely timed to occur at the desired location and angle of the bit.

PREFERRED EMBODIMENT

Figure 1:
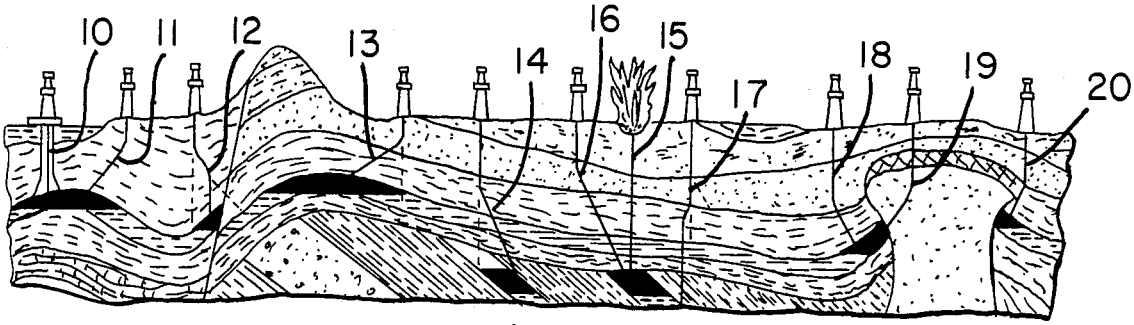
FIG. 1 is a cross sectional view illustrating different underground earth formations and various directionally drilled wells.

FIG. 1 generally illustrates many of the reasons for drilling directional holes (other than vertical and straight) into the earth. When drilling underwater from an artificial island, multiple bores 10 are often required to supply a common pumping station at the island, to reach an underwater formation from nearby land, a directional well 11 may also be bored from the shore. A directional well may also be drilled because of an earth fault, as shown at 12.

Additionally if the underground oil formation is inaccessable from the surface above due to difficult surface configurations, such as hills, a directional well 13 may often be required, similarly, to avoid having the well pass through other formations, a directional well 14 may also be drilled.

In the event of a blowout 15 in a well, a second bore 16 may be directionally drilled from a displaced location. Similarly for many other reasons, including salt dome drilling 18,19, and 20; and for straightening and side tracking 17, the wells are often required to be drilled downwardly at an angle or incline to reach an area or region other than vertically beneath the surface of the drill rig.

According to the present invention these directional holes are drilled by a rotating earth drill that fires projectiles to fracture and break the underground rock, and that employs conventional rotary drill bits to grind up and pulverize the broken rock. A suitable drill for this purpose is illustratively shown in FIG. 2 and is more fully disclosed in an earlier U.S. Pat. No. 4,004,642 of the same inventor.

Figure 2:
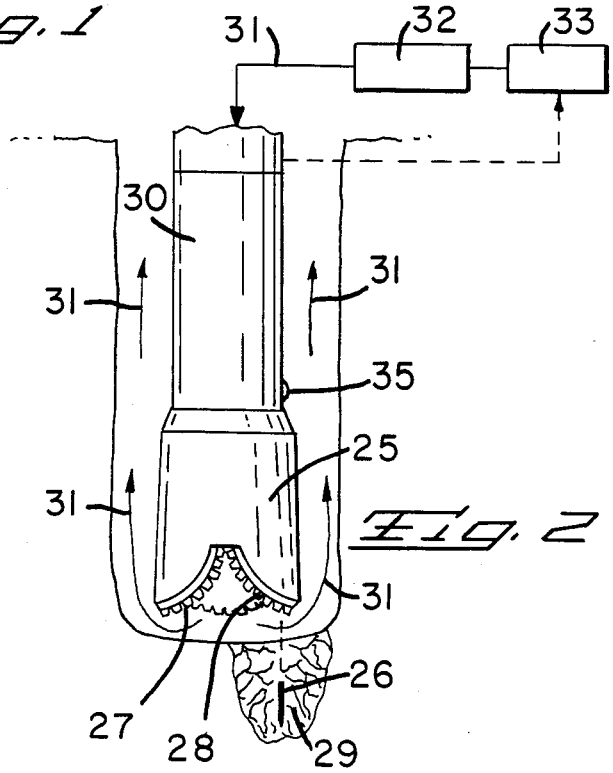
FIG. 2 is a side view of a projectile firing drill according to the invention, partially in section and partially in schematic form.

Referring to FIG. 2, the drill 25 generally comprises a series of displaced barrels (not shown) located interiorly of the head 25 for successively firing a salvo of projectiles 26 downwardly into the base of the borehole. These fired projectiles 26 operate to fracture and break up the rock 29, as shown, and the broken rock is ground and pulverized by the rotating drill bits 27,28 similar to those conventionally used for well drilling. The entire drill string comprised of pipe 30, drill 25, and bits 27 and 28 are usually rotated in a continuous manner to grind the rock, and the internal firing mechanism for firing the projectiles is triggered in a periodic or intermittantly repetitive manner, as needed, to fire and fracture and break up the rock.

Figure 3A:
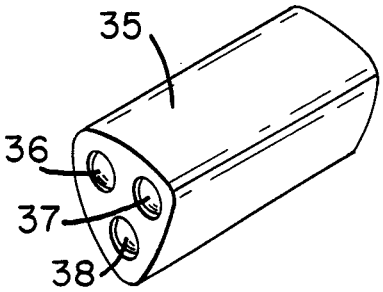
FIG. 3*a* and 3*b* are perspective views and sectional views of a salvo projectile firing charge used in the drill of FIG. 2.
Figure 3B:
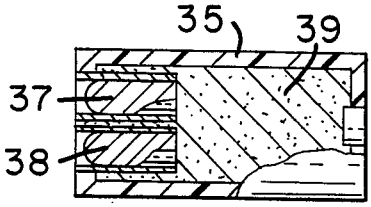

In the earth drill disclosed in earlier U.S. Pat. No. 4,004,642, the ammunition for firing the salvo of projectiles is preferably as shown in FIGS. 3*a* and 3*b*, and is disclosed in greater detail in earlier U.S. Pat. Nos. 3,434,380 and U.S. Pat. No. 3,855,931 of the same Inventor. As shown, each salvo firing charge is formed of an outer triangularly shaped casing or jacket 35 that is generally open ended from front to back, and is longitudinally compartmented to contain three projectiles 36,37, and 38 that are symmetrically arranged with respect to the central axis of the jacket 35. Behind the projectiles is located the ignitable propulsive charge 39, that when ignited propells the three projectiles through the associated three gun barrels (not shown) located inside the drill 25, to impact against the rock, as is generally illustrated by projectile 26 in FIG. 2.

In a preferred firing mechanism, as disclosed in the above patents, and in others of the present inventor, the gun mechanism and charges are of the open-chamber type that has been invented and pioneered by the present Inventor. In such mechanism a comparatively large number of the salvo firing charges are stored within a magazine in the drill and each charge is fed in succession to the multiple gun barrels (not shown) to fire the salvo of projectiles 36,27, and 38 from the drill head 25 into the rock as required. The triangular shape of jacket 35 for the salvo of projectiles, and the open chamber feeding and firing mechanism, insures that the multiple projectiles of each salvo are each properly aligned with an associated one of the three barrels. In one preferred system the individual ones of projectiles 36,37 and 38 of the salvo are fired in a predetermined time delayed manner to more effectively break up the rock by a process termed shock wave stress interaction. Further details of the open chamber gun mechanism and of the salvo ammunition, are disclosed in the above patents, and additional disclosure in this present application is not considered to be necessary.

In the usual method of drilling using this drill of FIG. 2 and salvo ammunition of FIGS. 3*a* and 3*b*, the salvo of projectiles 36,37, and 38 are fired into the rock in a symmetrical pattern with respect to the axis of the drill head 25 and drill pipe 30. Accordingly the rotating drill tends to normally drill straight downwardly or otherwise in a straight line direction, although it may wander resulting from other conditions. According to the present invention, the salvo of projectiles being fired is modified to fire in an unsymmetrical manner, in a direction offset from the central axis of the drill 25 and pipe 30. When modified to fire in an unsymmetrical manner, only the rock being impacted at the offset areas is fractured and broken. As a result the rotating drill follows the path of least resistance and advances forwardly in the direction of the offset.

In one preferred embodiment, this offset angle of firing of the projectiles is obtained by employing the same type of salvo ammunition as shown in FIGS. 3*a* and 3*b*, but with one or more of the projectiles 36,37, or 38 being removed from the jacket 35. By removal of any one of the projectiles, the locations of impact of the other two with the rock is offset from the central axis of the drill 25 and drill string 30 resulting in offset directional breakage of the rock, and in the drill 25 following a directional path that is displaced from the central axis of the drill.

To control the firing of the drill to fire each of the salvos at the same or at a given offset angle from those earlier fired, the present invention provides for monitoring or detecting the downhole angular position of the drill and gun barrels during drilling; and remotely controlling the time that the guns fire the salvo, such that each salvo of projectiles is fired at a desired offset angle as the drill head rotates during drilling.

A preferred manner of monitoring the angular position of the drill head (and of the gun barrels) is shown in FIG. 2. At the surface, an angle detector 33 is provided for continuously monitoring the angular position or displacement of the drill pipe 30 from a reference position, as it is continuously rotated during the drilling process. The three gun barrels (not shown) within the drill head 25 are fixed in position within the drill head 25; and the drill head, in turn, is fixedly attached at the downhole end of the drill pipe 30. Therefore as the drill pipe 30 continuously rotates in the bore, the drill head 25 containing the gun barrels also rotates by the same angle. By monitoring the angle of the drill pipe 30 at the surface, the driller at the surface continuously determines the angle of the projectile firing gun barrels in the drill head 25 with reasonable accuracy. Accordingly the driller at the surface can remotely control the firing of the projectiles from the drill head 25 at any desired offset angle, to thereby control the direction of drilling.

In a preferred embodiment, to remotely control the time of firing of the salvo at the drill head 25, a pressure responsive pick-up or transducer 34 is provided downhole in the drill string 30 near the drill head, and transducer 34 is interconnected with the projectile firing mechanism of the drill to be triggered to fire the guns upon detecting a particular surge of ambient pressure in the drill mud or air pressure.

In conventional deep hole drilling using pressurized mud 31 to remove the pulverized rock from the borehole, the pressurized mud 31 is pumped by pumps 32 from the surface into the interior of the hollow drill pipe 30 and down to the bottom of the well, where the mud exits into the bore from orifices in the drill head 25. From the bottom of the well the mud removes the pulverized or crushed rock and is forced upwardly by mud pressure to the surface (on the outside of the drill string 30), where the crushed rock is removed and the mud is recycled back into the well.

For remote control of the firing mechanism in the drill head 25, the high pressure of the pumped mud 31 is pulsed (by valves) under control of the driller, and the resulting mud pressure pulse is employed to trigger the downhole pressure transducer 34, thereby to fire the gun mechanism in the drill head 25 and release the salvo of projectiles at a desired offset angle with respect to the axis of the drill string 30 and drill head 25.

Thus the driller at the surface can remotely control the downhole firing of the projectiles at any desired offset angle, by continuously monitoring the angle of rotation of the drill pipe 30 thereby to continuously monitor the rotative angle of the gun barrels downhole in the well. When approaching the desired angle, the mud pressure 31 is pulsed by the mud pump 32, or valves, to fire the gun, insuring that the projectiles are fired at a desired offset angle to drill in a direction desired. It will be appreciated that the gun firing mechanism is not remotely triggered to fire during each revolution of the drill pipe 30, but only as necessary for efficient operation of the drilling process.

In the event that the drilling system uses compressed air instead of mud 31 for removing the comminuted or crushed rock, the preferred process for remotely controlling the firing of the gun is the same, and the pressure of the compressed air is pulsed from the surface to remotely trigger the pressure transducer or pick-up 35 and fire the gun downhole in the bore.

Figure 5:
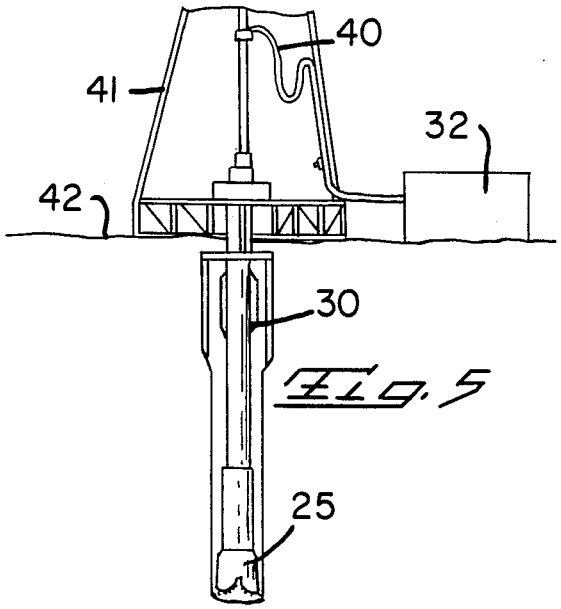
FIG. 5 is a view, partly in cross section, showing the drill rig and drill string in the bore hole and the mud pumping system.

FIG. 5 generally illustrates a typical drill rig 41 disposed above ground 42 for rotating the drill string 30 and drill head 25 in the borehole. As shown, the high power mud pumps 32 located at the surface force the pressurized drill mud 31 through piping 40 into the interior of the hollow drill pipe 30 and then through the drill pipe downhole to the bottom of the borehole, as described above.

In directional drilling, as well as in all deep drilling, it is important to monitor the path of the borehole and the changing location of the drill head 25 as the borehole is being drilled. Having this information, the driller can continually compare the position and location of the actual borehole and bottom with the desired position and can remotely change the direction of drilling, as described above, to conform with that desired. A method and apparatus for monitoring the downhole position of the drill 25 at different depths is disclosed in copending application of the same Inventor, Ser. No. 399,097, filed 7/16/82, and is partially disclosed in FIG. 4.

Figure 4:
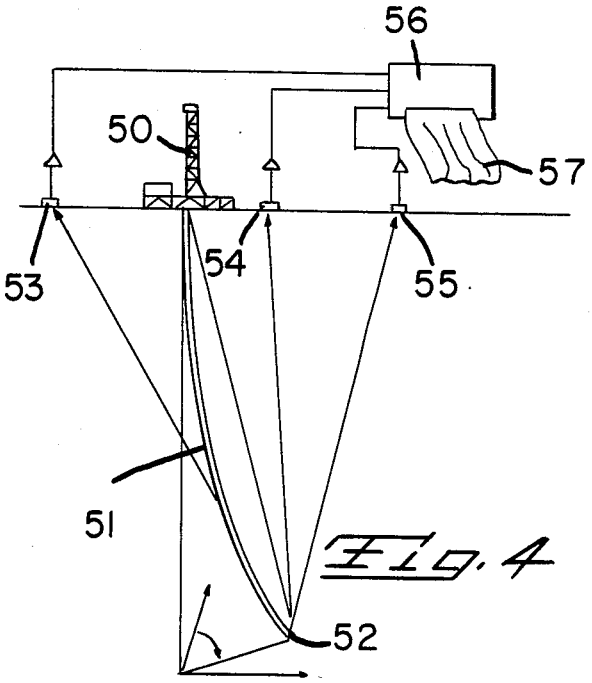
FIG. 4 is a cross sectional view showing an oil rig, well, and plural surface transducers for locating the downhole position of the drill.

Referring to FIG. 4, the above surface drill rig is generally shown at 50 and the path of the deep and curved borehole into the earth is shown at 51 leading to the bottom at 52. At the surface is provided a series of three sonic or acoustic detectors 53,54, and 55 that are spaced apart from each other in a two axis pattern as shown. The transducers 53,54, and 55 provide transduced signals to a data processor 56 and printer having a printout 57. As described in said copending application, each firing of a salvo of projectiles during drilling to break the rock, provides very high intensity acoustic pulses that travel through the earth from the area of impact to the transducers 53,54, and 55 where they are detected. The transduced signals are compared and triangulated by the data processor 56, and a continual print-out recording is made at 57. The location of the drill head 25 is continuously determined with respect to three axis during each firing. Using a series of such measurements, the well path 51 is continually determined and is also preferably plotted on the print-out 57.

Although but one preferred embodiment has been illustrated and described, many changes may be made by those skilled in the art without departing from the scope of this invention. Accordingly this invention should be considered as being limited only by the following claims.

What is claimed is:

1. In a system for surface controlled directional drilling of the earth employing a downhole drill including a gun for successively firing projectiles into the earth at offset positions relative to the central axis of the drill string, acoustic detecting and triangulating means near the surface for detecting the firing of the gun and impacting of the projectiles with rock and determining the downhole location of the drill, and remote control means near the surface for controlling the firing of projectiles from the guns at a desired offset location relative to the drill string thereby to control the direction of drilling.

2. In the system of claim 1, said gun being rotated with the drill and firing at a location offset from the axis of the drill, and control means operated from the surface for controlling the firing of the gun when the drill and firing mechanism is positioned at a desired angular location in the borehole.

3. In the system of claim 1, said gun being rotatable with said drill and firing projectiles at a location offset from the axis of the drill, remote controlling means at the surface for controlling the time of firing the gun, and means at the surface for timing the operation of said remote controlling means to fire the gun at a desired angular position of the drill referenced to the borehole.

4. In the system of claim 1, wherein said drill also includes rotary rock grinding bits at the end of a drill string progressively lowered into the borehole, and including a pressurized fluid being pumped from the surface into the borehole and returned in a circulated fashion to remove pulverized rock and comminuted earth materials, said firing mechanism being triggered to fire by a downhole detector near the drill head and responsive to abrupt changes in the pressure of the circulating pressurized fluid, and said remote control means at the surface pulsing the pressurized fluid to fire the gun at a desired angular position of the drill in the borehole.

5. In a system for surface controlled directional drilling and boring of the earth employing a rotary downhole drill on a drill string and including a gun for successively firing projectiles into the earth at desired locations offset from the axis of the drill string, remote control means triggered at the surface for controlling the firing of the gun at a given angular position of the drill in the borehole to control the desired direction of drilling into the earth.

6. In the system of claim 5, said remote control means including monitoring means at the surface for the rotation of said drill string, and determining when the gun reaches a desired angular position, and remotely controlled triggering means at the surface for at that position.

7. In the system of claim 5, said remote control triggering means timing the firing of said gun during rotation of the drill at a desired angular position of the drill in the borehole.

8. In the system of claim 5, said gun firing a salvo of projectiles during each firing in an unsymmetrical pattern with respect to the axis of the drill, with the projectiles in each salvo being time delayed with respect to each other.

9. In the system of claim 5, the firing mechanism for said gun including a pressure responsive switch located downhole near said gun, said drilling system employing a circulated pressurized fluid injected at the surface to remove the rock and other drilled materials from the bore, and said remote control triggering means pulsing the pressure of the fluid to actuate said pressure responsive switch.

* * * * *